US008322134B2

(12) United States Patent
Wieland et al.

(10) Patent No.: US 8,322,134 B2
(45) Date of Patent: Dec. 4, 2012

(54) SLIDING FIT, PIPE ARRANGEMENT AND EXHAUST GAS TREATMENT DEVICE

(75) Inventors: Arthur Wieland, Wolfschlugen (DE); Michael Krause, Albershausen (DE); Rainer Lehnen, Ebersbach (DE); Georg Wirth, Kirchheim/Teck (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 803 days.

(21) Appl. No.: 12/337,256

(22) Filed: Dec. 17, 2008

(65) Prior Publication Data

US 2009/0158721 A1 Jun. 25, 2009

(30) Foreign Application Priority Data

Dec. 24, 2007 (DE) ..... 10 2007 062 663

(51) Int. Cl.
*F01N 1/00* (2006.01)

(52) U.S. Cl. ..... 60/322; 60/295; 60/297; 60/311; 181/227; 181/232; 181/241; 285/148.1; 285/214

(58) Field of Classification Search ..... 60/274, 60/285–287, 295–301, 320–324
See application file for complete search history.

(56) References Cited

U.S. PATENT DOCUMENTS 2,070,543 A * 2/1937 Hollerith et al. ..... 181/266
3,690,406 A * 9/1972 Weiss ..... 181/227
3,898,802 A * 8/1975 Tadokoro et al. ..... 60/282
4,188,783 A * 2/1980 Sayo et al. ..... 60/277
4,381,045 A * 4/1983 Buchwalder ..... 181/265
4,735,283 A * 4/1988 Macaluso ..... 181/265
5,043,147 A * 8/1991 Knight ..... 422/180
5,358,287 A * 10/1994 Winzen ..... 285/227
5,506,376 A 4/1996 Gödel
5,606,857 A * 3/1997 Harada ..... 60/322
5,907,134 A * 5/1999 Nording et al. ..... 181/228
6,058,698 A * 5/2000 Coral et al. ..... 60/275
6,394,225 B1 * 5/2002 Yasuda ..... 181/256
6,397,586 B1 * 6/2002 Sakurai et al. ..... 60/288
6,543,575 B1 * 4/2003 Marcellus ..... 181/224
6,679,742 B2 * 1/2004 Yokoya et al. ..... 440/89 J
6,837,336 B2 * 1/2005 Gault et al. ..... 181/258
6,941,751 B2 * 9/2005 Yamamoto et al. ..... 60/322
7,051,523 B2 * 5/2006 Kerchner ..... 60/322
7,093,428 B2 * 8/2006 LaBarge et al. ..... 60/286
7,350,351 B2 * 4/2008 Ueshima et al. ..... 60/299
7,866,143 B2 * 1/2011 Buhmann et al. ..... 60/286
2002/0033304 A1 * 3/2002 Watanabe et al. ..... 181/275
2003/0221424 A1 * 12/2003 Woerner et al. ..... 60/297
2006/0053779 A1 * 3/2006 Belisle et al. ..... 60/299

(Continued)

FOREIGN PATENT DOCUMENTS

DE 92 05 294.0 U1 6/1992

(Continued)

*Primary Examiner* — Kenneth Bomberg
*Assistant Examiner* — Jesse Bogue
(74) *Attorney, Agent, or Firm* — Reinhart Boerner Van Deuren P.C.

(57) ABSTRACT

The present invention relates to a sliding fit for the axially movable bearing of a thermally loaded pipe on a component, in particular on an exhaust system of an internal combustion engine, having a wire mesh which is radially supported on the outside of the pipe and is secured directly or indirectly to the component.

22 Claims, 6 Drawing Sheets

U.S. PATENT DOCUMENTS

| | | | | |
|---|---|---|---|---|
| 2006/0113145 | A1* | 6/2006 | Toyoshima et al. | 181/268 |
| 2006/0150617 | A1* | 7/2006 | Nishimura et al. | 60/289 |
| 2006/0156712 | A1* | 7/2006 | Buhmann et al. | 60/297 |
| 2006/0266022 | A1* | 11/2006 | Woerner et al. | 60/295 |
| 2007/0130914 | A1* | 6/2007 | Westerbeke, Jr. | 60/274 |
| 2007/0137184 | A1* | 6/2007 | Patchett et al. | 60/286 |
| 2007/0144126 | A1* | 6/2007 | Ohya et al. | 55/502 |
| 2007/0193255 | A1* | 8/2007 | Satou | 60/286 |
| 2007/0284186 | A1* | 12/2007 | Thayer et al. | 181/232 |
| 2008/0121451 | A1* | 5/2008 | Kertz et al. | 180/69.24 |
| 2009/0266065 | A1* | 10/2009 | Barrieu et al. | 60/323 |

FOREIGN PATENT DOCUMENTS

| | | | |
|---|---|---|---|
| DE | 43 18 343 | A1 | 12/1994 |
| DE | 199 29 423 | A1 | 1/2000 |
| DE | 199 18 301 | C1 | 10/2000 |
| DE | 100 21 494 | A1 | 8/2001 |
| DE | 101 05 841 | A1 | 8/2002 |
| DE | 10 2004 021 474 | B3 | 3/2005 |
| DE | 103 34 307 | A1 | 3/2005 |
| EP | 0 537 603 | A1 | 4/1993 |
| EP | 0 580 963 | A1 | 2/1994 |
| EP | 1 329 608 | A | 7/2003 |
| FR | 2 617 536 | A1 | 1/1989 |
| JP | 08-004524 | | 1/1996 |
| JP | 2004-162610 | | 6/2004 |
| WO | WO 2006/117468 | A1 | 11/2006 |

* cited by examiner

SLIDING FIT, PIPE ARRANGEMENT AND EXHAUST GAS TREATMENT DEVICE

CROSS-REFERENCE TO RELATED PATENT APPLICATIONS

This patent application claims the benefit of co-pending German Patent Application No. DE 102007062663.2, filed Dec. 24, 2007, the entire teachings and disclosure of which are incorporated herein by reference thereto.

FIELD OF THE INVENTION

The present invention relates to a sliding fit for the axially movable bearing of a thermally loaded pipe on a component, in particular on an exhaust system of an internal combustion engine. The invention also relates to a pipe arrangement in which at least one pipe is mounted with such a sliding fit on a carrier component. In addition, the present invention relates to an exhaust gas treatment device with such a pipe arrangement or with such a sliding fit.

BACKGROUND OF THE INVENTION

In order to be able to attach thermally loaded pipes permanently to a carrier, it is customary to fasten the respective pipe to a fixed bearing, on the one hand, and to a freely moving bearing, on the other hand, on the respective carrier so that the length of the pipe relative to the carrier can change without unacceptably high stresses occurring between the pipe and the carrier. In order to implement such a freely moving bearing, what are referred to as sliding fit arrangements can be used in which the pipe is seated in a receptacle opening which is formed in the respective carrier, said pipe being specifically seated in such a way that it is axially adjustable, in terms of its longitudinal axis, in relation to the carrier.

Thermally loaded pipes which are mounted on a carrier component by means of a sliding fit are used in many technical fields, predominantly where hot or cold fluids are transported in pipes. For example, this set of problems occurs in heating systems, cooling systems and exhaust systems. Exhaust systems are found in heating devices and in internal combustion engines, preferably in motor vehicles. For example an exhaust gas treatment device can contain at least one pipe which is mounted in a housing of the exhaust gas treatment device using such a sliding fit. An exhaust gas treatment device may be, for example, a particle filter, a catalytic converter or a sound damper or any desired combination of such devices.

A conventional sliding fit can have a certain degree of radial play between the pipe and the respective receptacle opening in order to facilitate the axial adjustability of the pipe in the fit. This is unfavorable for applications which require a certain degree of gas-tightness since it is basically possible for gas to be exchanged through the sliding fit. In particular in the case of an exhaust system, it is necessary to prevent exhaust gas from escaping into the surroundings, for example through a sliding fit, in view of more stringent regulations relating to environmental protection.

In addition, in conventional sliding fit arrangements there is basically the problem of comparatively high mechanical loading of the pipe or of the respective carrier part within the sliding fit. Mechanical loading is associated with wear and can lead to disruptive generation of noise.

BRIEF SUMMARY OF THE INVENTION

Embodiments of the present invention are concerned with the problem of specifying an improved embodiment for a sliding fit or for a pipe arrangement or for an exhaust gas treatment device, which improved embodiment is distinguished in particular by the fact that basically a certain sealing effect can be implemented and/or that the mechanical loading within the sliding fit is reduced.

Embodiments of the invention are based on the general idea of equipping the respective sliding fit with a wire mesh which, on the one hand, is permanently attached directly or indirectly to the respective component, and which, on the other hand, is supported radially on the outside of the pipe. During operation, the pipe can slide along the wire mesh if a length changes owing to a thermal loading. Because such a wire mesh has a certain degree of spring-elastic resilience, the mechanical loading on the pipe or on the component within the sliding fit decreases. At the same time, radially oriented relative movements between the pipe and component, which may occur, for example, owing to vibrations during operation, can be sprung or damped. Associated noise can therefore be effectively reduced.

Further important features and advantages of the invention emerge from the claims, from the drawings and from the associated description of the figures on the basis of the drawings.

Of course, the features mentioned above and those still to be explained below can not only be used in their respectively specified combination but also in other combinations or alone without departing from the scope of the present invention.

Other aspects, objectives and advantages of the invention will become more apparent from the following detailed description when taken in conjunction with the accompanying drawings.

BRIEF DESCRIPTION OF THE DRAWINGS

Preferred exemplary embodiments of the invention are illustrated in the drawings and will be explained in more detail in the following description, in which identical reference signs refer to identical or similar or functionally identical components. In said drawings, in each case in a schematic view.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
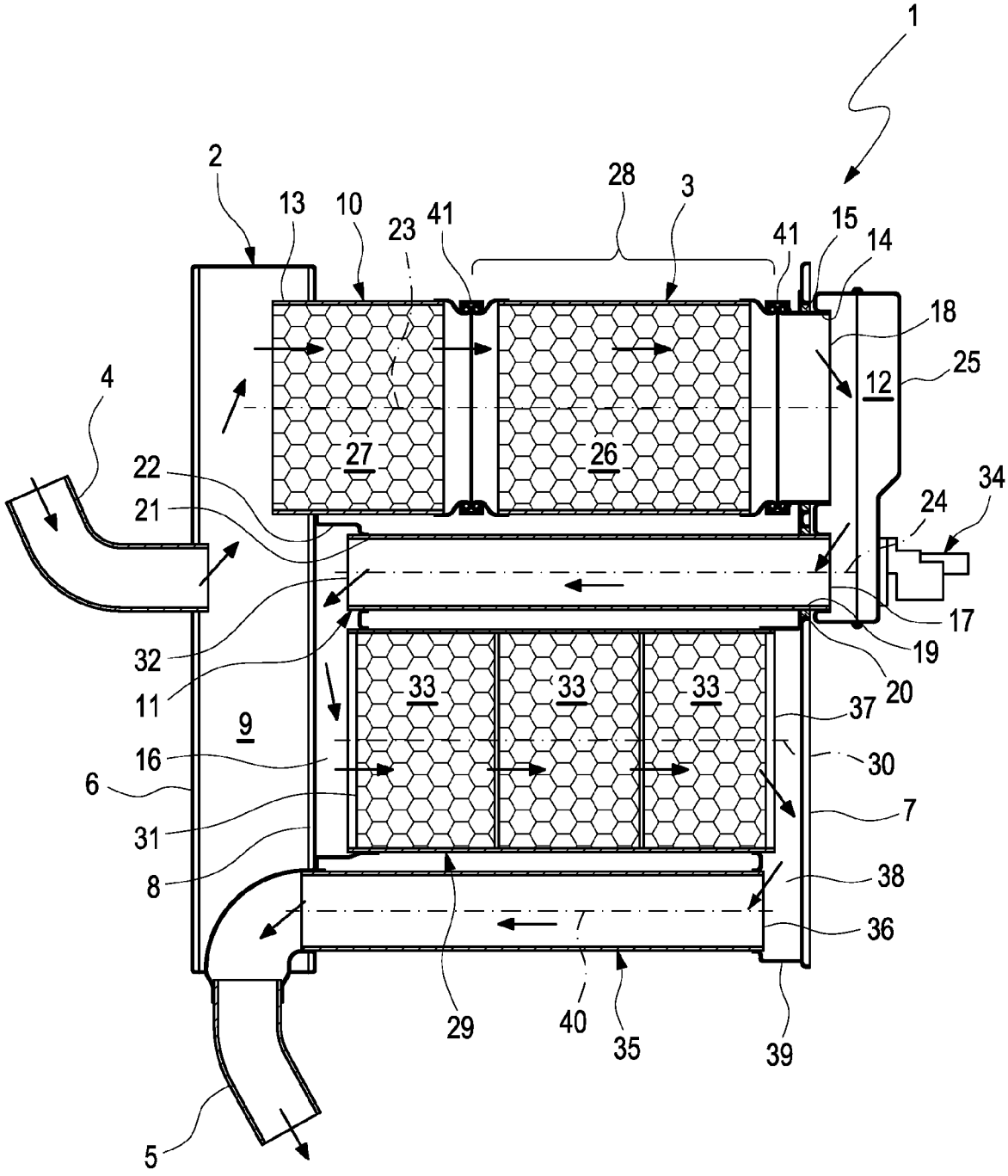
FIG. 1 shows a highly simplified longitudinal section through an exhaust gas treatment device.

According to FIG. 1, an exhaust gas treatment device 1 comprises a housing 2 and at least one pipe arrangement 3. The housing 2 has at least one inlet 4 and at least one outlet 5. The housing 2 has, in the embodiment shown here, two end plates 6 and 7 and an intermediate plate 8. The first end plate 6 bounds an inlet chamber 9 with the intermediate plate 8 in the housing 2. The inlet 4 is connected, in the form of an inlet connector, to the first end plate 6.

The pipe arrangement 3 comprises at least two pipes which communicate with one another, specifically a first pipe 10 and a second pipe 11. The first pipe 10 communicates on the inlet side with the inlet chamber 9 and on the outlet side with a deflection chamber 12. The first pipe 10 is attached, in an inlet section 13, to a carrier component which is formed here by the housing 2 or by a component of the housing 2, specifically here by the intermediate plate 8. In an outlet section 14, the first pipe 10 is also secured with a sliding fit 15 to the carrier component, that is to say to the housing 2, specifically to the second end plate 7. The second pipe 11 communicates on the inlet side with the deflection chamber 12 and on the outlet side with a chamber 16 which can serve as a further deflection chamber or as a distributor chamber. An inlet 17 of the second pipe 11 communicates with an outlet 18 of the first pipe 10 via the deflection chamber 12. Because the deflection chamber 12 connects the two pipes 10, 11 to one another in a communicating fashion, it can also be referred to below as a connecting chamber 12. In an inlet section 19, the second pipe 11 is secured with a sliding fit 20 to the carrier component, that is to say to the housing 2, specifically to the second end plate 7. Furthermore, in an outlet section 21, the second pipe 11 is also connected to the carrier component, that is to say to the housing 2. In the present case, the housing 2 contains, for the purpose of forming the chamber 16, a shell body 22 to which the second pipe 11 is attached in its outlet section 21.

The first pipe 10 has a first longitudinal center axis 23. The second pipe 11 correspondingly has a second longitudinal center axis 24. In the embodiment shown, the two longitudinal center axes 23, 24 extend parallel to one another. Both pipes 10, 11 penetrate the respective plates 7 in separate openings.

In the embodiment shown here, the outlet 18 of the first pipe 10 and the inlet 17 of the second pipe 11 each lead in an open fashion into the connecting chamber 12. The connecting chamber 12 is formed here by one or more shell bodies 25 which are built on to the outlet section 14 of the first pipe 10, and onto the inlet section 19 of the second pipe 11. Alternatively, an embodiment is possible in which said shell bodies 25 are built on to the second end plate 7. Likewise, an embodiment is possible in which, instead of a connecting chamber 12, a bent connecting pipe is used in order to connect the two pipes 10, 11 to one another. Said connecting pipe then connects the outlet 18 of the first pipe 10 to the inlet 17 of the second pipe 11.

The embodiment shown here is concerned with an exhaust gas treatment device 1 which can be used in an exhaust system of an internal combustion engine, wherein this internal combustion engine can be located, in particular, in a motor vehicle, preferably in a utility vehicle. The exhaust gas treatment device 1 is of multifunctional configuration here and contains at least one particle filter element 26 which is arranged in the first pipe 10. In addition, the exhaust gas treatment device 1 has here at least one oxidation catalytic converter element 27 which is also arranged in the first pipe 10 here, specifically expediently upstream of the particle filter element 26. Furthermore, the exhaust gas treatment device 1 can carry out a sound damping function.

The first pipe 10 has here a radially removable axial section 28, indicated here by a curvy bracket. Said axial section 28 is attached to the other sections of the first pipe 10 by means of quick-release attachment elements 41, for example in the form of clamp or the like. For this purpose, corresponding flanges can be formed with which the attachment elements 41 interact. The particle filter element 26 is expediently arranged within the radially removable axial section 28. In this way, the respective particle filter element 26 can, for example, be easily renewed or replaced. In this context, the entire unit is composed of the axial section 28 and particle filter element 26 inserted therein is expediently replaced.

In the example, a third pipe 29 is also provided whose longitudinal center axis 30 can also be aligned parallel to the longitudinal center axes 23, 24 of the two other pipes 10, 11. An outlet 31 of the third pipe 29 communicates with an outlet 32 of the second pipe 11. In the example, the second pipe 11 and the third pipe 29 lead into the chamber 16, with the result that the latter produces the communicating connection between the two pipes 11, 29. The third pipe 29 can contain at least one SCR catalytic converter 33. In the example, three such catalytic converter elements 33 are arranged one behind the other in the third pipe 29. By using such an SCR catalytic converter 33 it is possible to implement a selective catalytic reduction of specific pollutants.

In the example, the exhaust gas treatment device 1 also has a metering device 34 which can be used to feed a liquid educt into the exhaust gas stream. The metering device 34 can expediently be used to introduce ammonia or urea or preferably an aqueous urea solution into the exhaust gas stream. Urea can be processed into ammonia by means of a hydrolysis reaction. Ammonia can be used to convert nitrous oxides into nitrogen. The corresponding reactions occur in the SCR catalytic converter 33.

The metering device 34 can be arranged or configured in such a way that in all cases it feeds the respective educt into the exhaust gas stream upstream of the SCR catalytic converter 33. The injection expediently occurs downstream of the particle filter 26. The injection can basically occur into the deflection chamber 12. The metering device 34 preferably feeds the educt into the inlet section 19 of the second pipe. The injection of the educt can, however, also take place upstream of the second pipe 11. The second pipe 11 can serve here as a mixing section for exhaust gas and fed-in educt in order to implement intensive mixing of the exhaust gas and educt.

In the example shown here, the exhaust gas treatment device also has a fourth pipe 35 which is connected to the outlet 5 or which is connected to the outlet 5 which is configured as an outlet connector. An inlet 36 of the fourth pipe 35 is connected in a communicating fashion to an outlet 37 of the third pipe 29. This is achieved here by means of a further deflection chamber 38 which is implemented using a shell body 39 and the second end plate 7. A longitudinal center axis 40 of the fourth pipe 35 extends in the present case back parallel to the longitudinal center axes 23, 24 of the first pipe 10 or of the second pipe 11.

In the sectional view of the exhaust gas treatment device 1 which is shown here, in each case, just a single first pipe 10, a single second pipe 11, a single third pipe 29 and a single fourth pipe 35 can be seen. It is clear that in particular embodiments at least multiple examples of at least one of said pipes 10, 11, 29, 35 can be present. For example, a plurality of second pipes 11 and/or a plurality of third pipes 29 may be provided with SCR catalytic converters 33.

Figure 2:
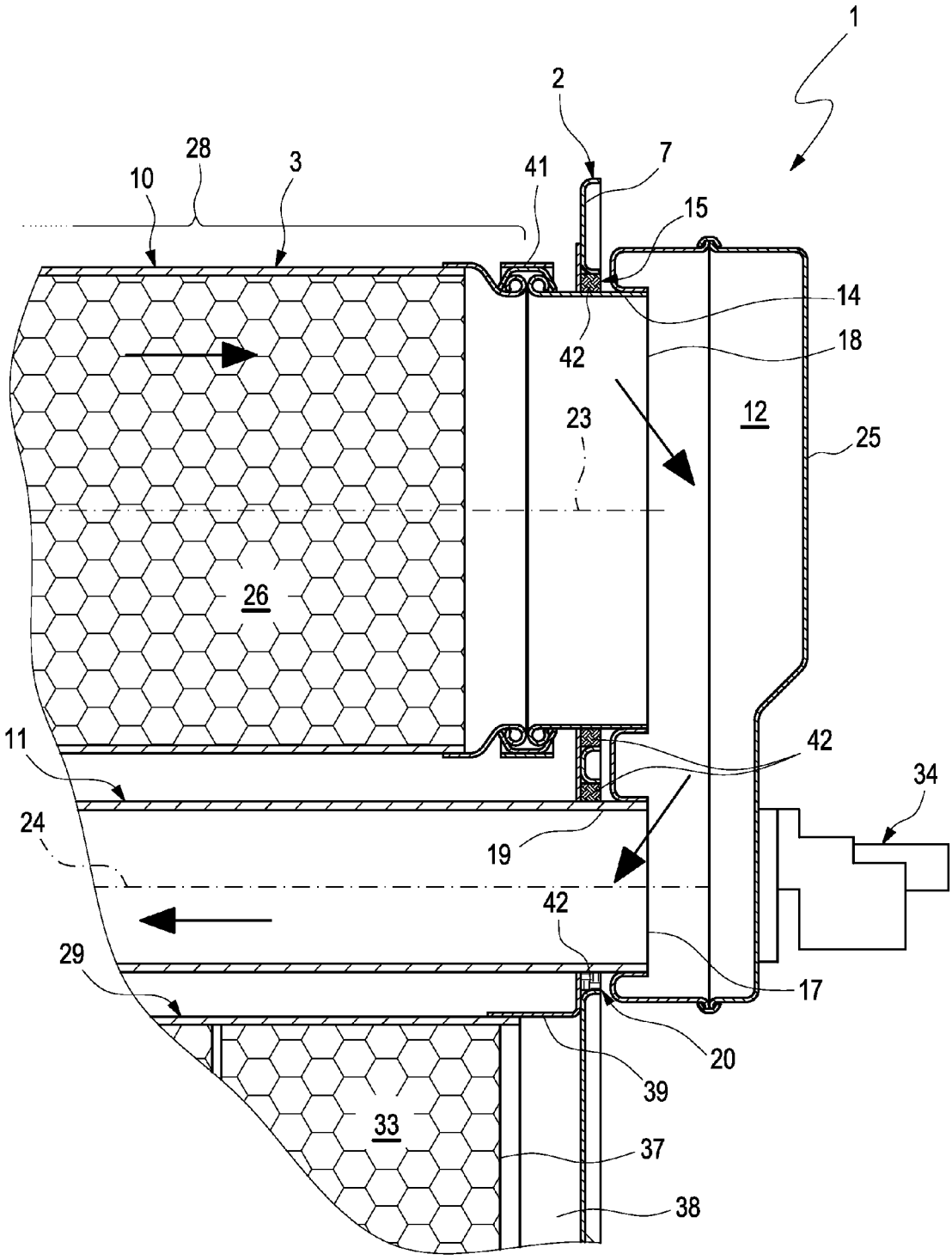
FIG. 2 shows an enlarged illustration of a detail of the exhaust gas treatment device in the region of the pipe arrangement.

According to FIG. 2, the sliding fit 15 with which the first pipe 10 is mounted on the carrier component 2 or the housing 2 has a wire mesh 42. This wire mesh 42 is fixedly arranged with respect to the component 2, that is to way with respect to the housing 2, and is supported radially on the outside of the first pipe 10. The pipe 10 can therefore move in its axial direction along the wire mesh 42. The wire mesh 42 itself is secured directly or indirectly to the housing 2.

Additionally or alternatively, the sliding fit 20 with which the second pipe 11 is mounted on the carrier component 2 or on the housing 2 has a wire mesh 42 which is, on the one hand, supported radially on the outside of the second pipe 11 and is supported directly or indirectly on the component 2 or on the housing 2.

Basically wire meshes which can be used to secure a catalytic converter element in a catalytic converter housing are possible as the wire mesh 42. Such wire meshes 42 are distinguished by a comparatively high resistance to temperature and by a certain degree of spring elasticity. By using the wire mesh 42 it is possible for the respective fit 15 or 20 to secure the respective pipe 10, 11 radially and nevertheless permit axial relative movements between the pipe 10, 11 and housing 2 or second end plate 7.

Basically, the wire mesh 42 can be composed of a plurality of wire mesh pillows which are arranged distributed in the circumferential direction and spaced apart from one another. The wire mesh 42 is formed here from a plurality of parts, that is to say from a plurality of separate wire mesh pillows. However, if a certain degree of tightness is important in the sliding fit 15 or 20, the respective wire mesh 42 is preferably configured in such a way that it is composed at least of a mesh ring which surrounds the respective pipe 10, 11 in a closed annular shape in the circumferential direction. In the embodiments shown in FIGS. 2 to 7 here, in each case just a single mesh pillow or a single mesh ring can be seen. If a plurality of mesh rings are present, they are expediently arranged axially one next to the other.

Figure 4:
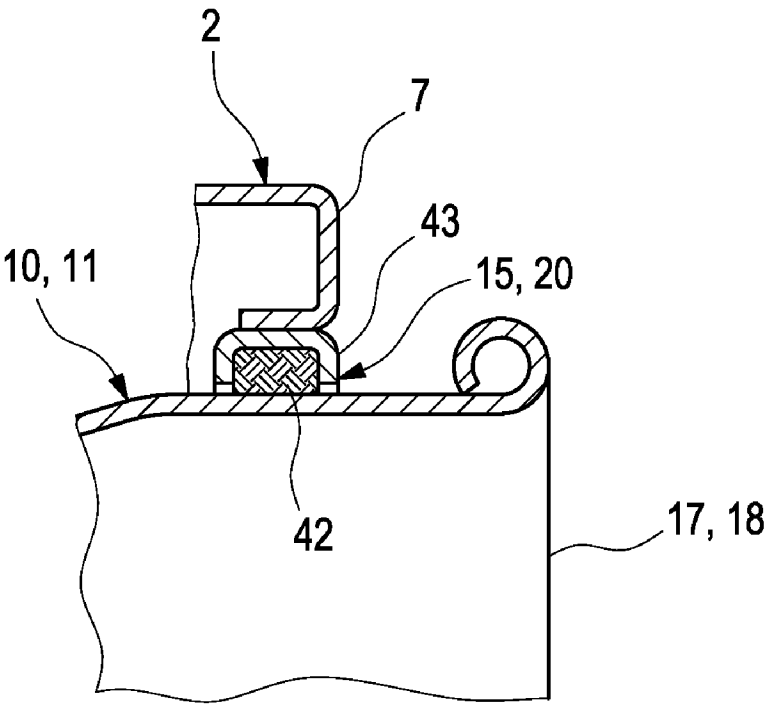
FIGS. 3 to 7 show highly simplified enlarged illustrations of the pipe arrangement in the region of a sliding fit, for different embodiments.
Figure 3:
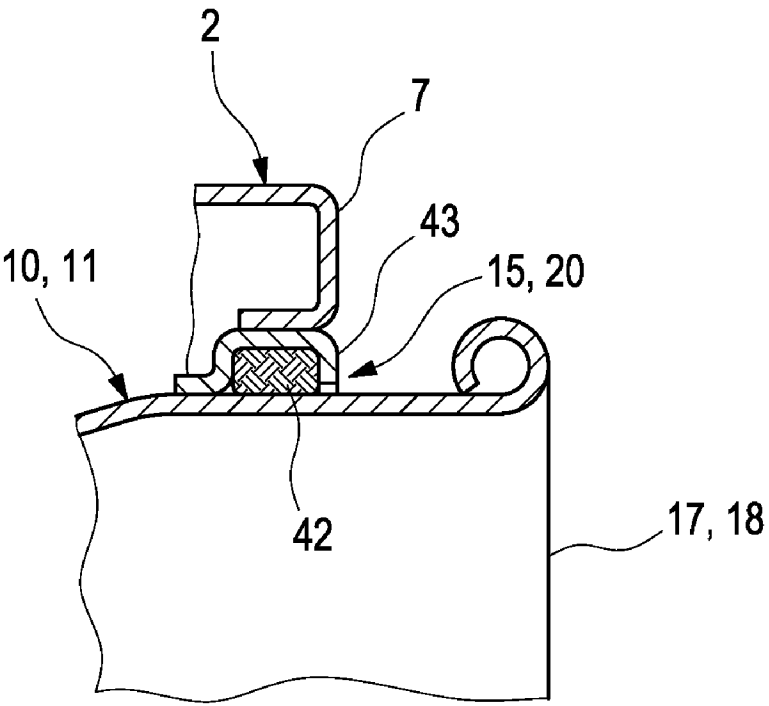

In the embodiments in FIGS. 3 and 4, the respective sliding fit 15, 20 is additionally equipped with a fastener 43 which is attached to the respective component 2, that is to say here to the housing 2 or to its bottom plate 7. Said fastener 43 serves to secure the wire mesh 42 to the component 2, that is to say to the housing 2. The fastener 43 can, for example, be configured in an annular shape and extend around the respective pipe 10, 11 in the circumferential direction. The fastener 43 is distinguished in the embodiments in FIGS. 3 and 4 by a U profile which forms an open annular groove which is radially toward the inside and into which the wire mesh 42 is inserted.

Figure 5:
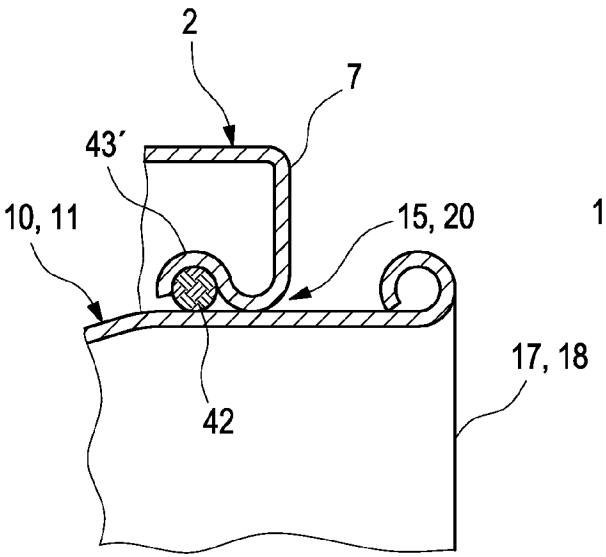

In the embodiment shown in FIG. 5, said fastener 43' is, as it were, integrated into the component 2 or the housing 2, and specifically here by means of corresponding shaping of the bottom plate 7 in the edge region of an opening (not denoted in more detail) through which the respective pipe 10, 11 is plugged through the bottom plate 7.

Figure 7:
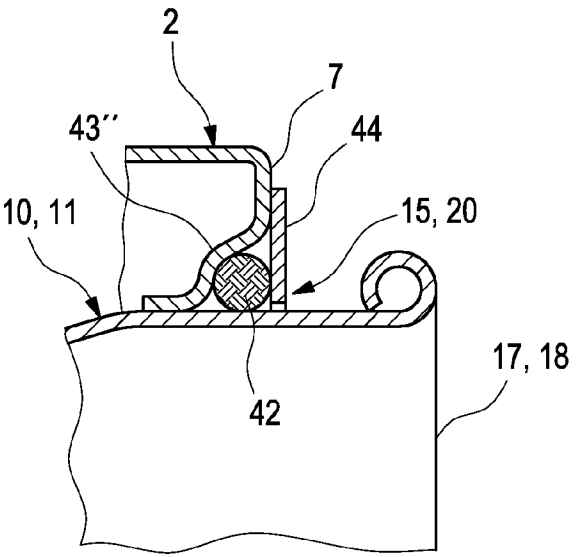
Figure 6:
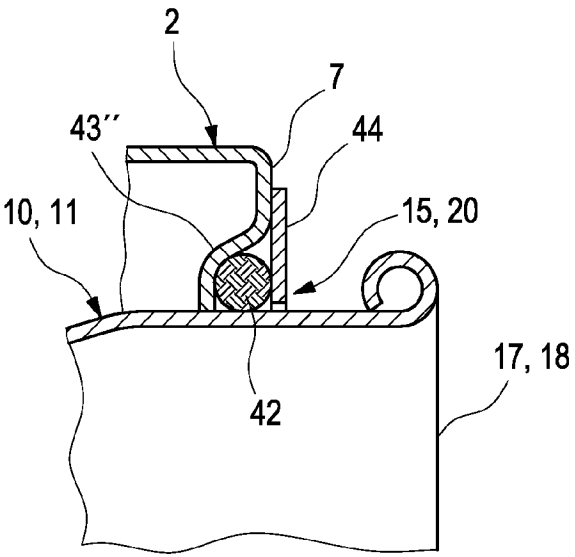

In the embodiments in FIGS. 6 and 7, the faster 43" is formed by virtue of the fact that the component 2 is contoured in the region of the sliding fit 15, 20 in order to form a receptacle which is completed with a cover 44 in order to form the fastener 43".

In the embodiments in FIGS. 3 and 4, the wire mesh 42 has a rectangular or oval cross section. In the embodiments in FIGS. 5 to 7, the wire mesh 42 has a circular cross section. In the embodiments in FIGS. 3 and 7, a radial support, which acts in addition to the wire mesh 42 and operates with the formation of contact between the fastener 43, 43" and pipe 10, 11, can be implemented in the sliding fit 15, 20 by means of the fastener 43 or 43". In contrast thereto, in the embodiments in FIGS. 4 to 6 the radial support in the sliding fit 15, 20 occurs exclusively via the wire mesh 42.

Figure 8:
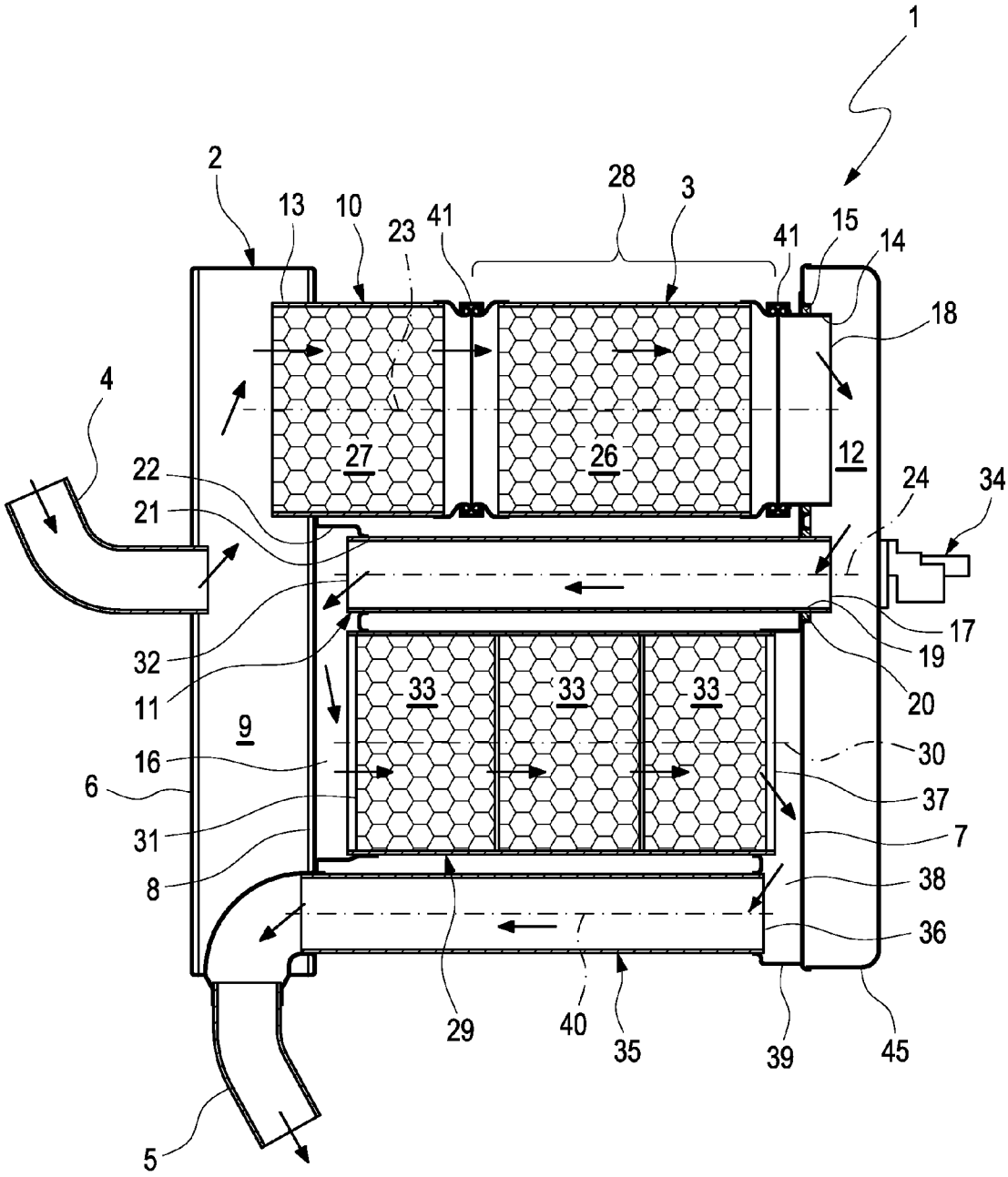
FIGS. 8 and 9 respectively show a longitudinal section as in FIG. 1 but for other embodiments.

The embodiment according to FIG. 8 differs from that according to FIG. 1 only in that the deflection chamber 12 now extends over the entire height or side of the second end plate 7 or of the exhaust gas treatment device 1. This permits the counter pressure to be reduced. For this purpose, a shell-shaped lid body 45 is integrally formed on the second end plate 7, with the result that the deflection chamber 12 is surrounded or bounded by the second end plate 7 and the lid body 45. In contrast to this, in the embodiment according to FIG. 1 the shell body 25 forms, with a deflection chamber 12 which is surrounded or bounded by it, a component which is separate with respect to the second end plate 7.

Figure 9:
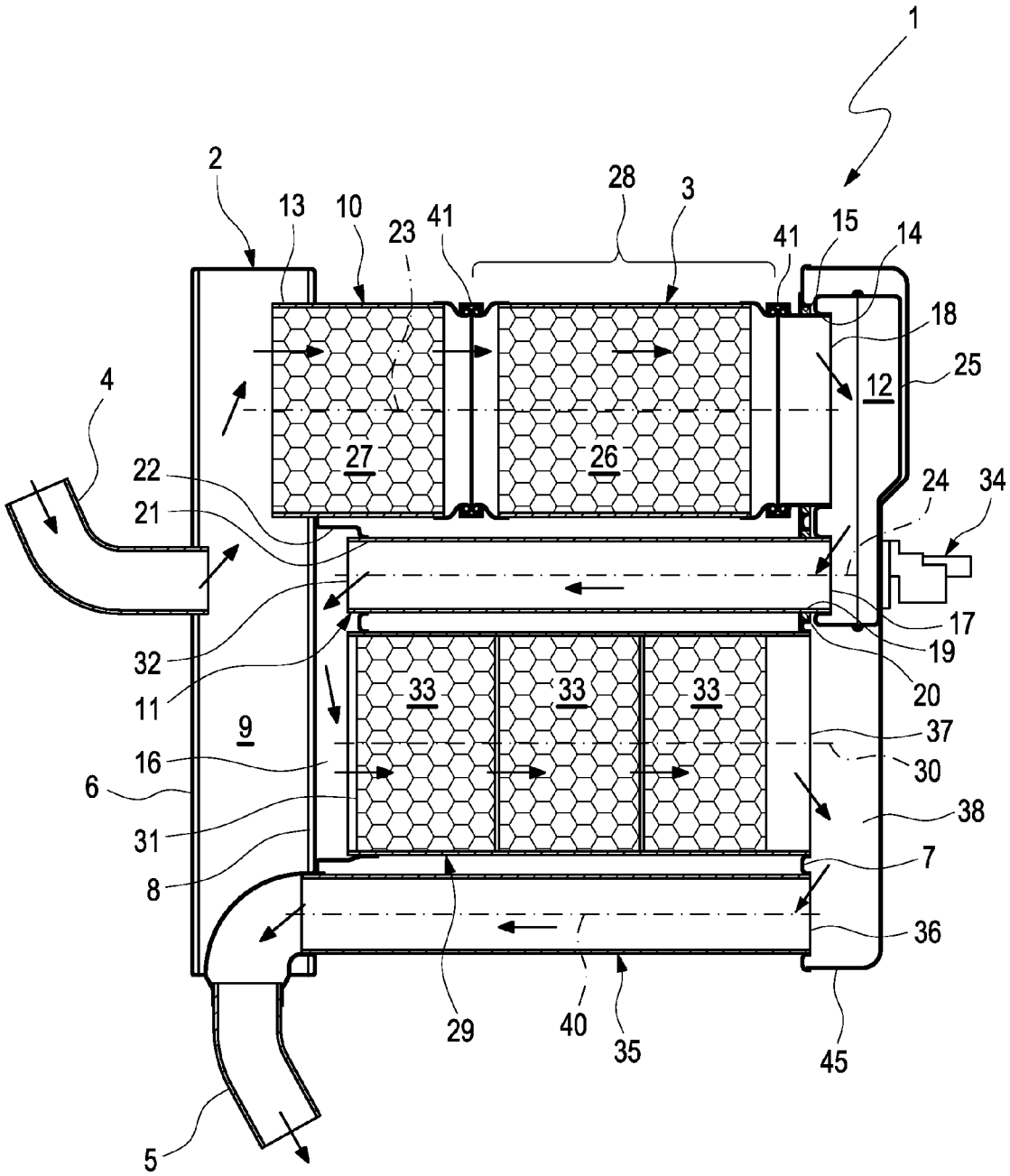

In the embodiment according to FIG. 9, both the shell body 25, which is separate with respect to the second end plate 7 and has the purpose of forming the deflection chamber 12, and the lid body 45, which extends over the entire second end plate 7 and is attached thereto, are provided. As a result, the deflection chamber 12 is enclosed doubly within the exhaust gas treatment device 1, specifically within the shell body 25 and within the lid body 45. The interior of the shell body 25 is separated here in a gas-tight fashion from the interior of the lid body 45. As a result, the lid body 45, together with the second end plate 7, can form the space or the chamber 38 which deflects the exhaust gas from the third pipe 29 into the fourth pipe 35. In this design, it is possible to dispense with the other shell body 39 which forms or surrounds the entire deflection space 38 in the embodiments in FIGS. 1 and 8.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pipe arrangement, for an exhaust system of an internal combustion engine comprising:

at least two thermally loaded pipes which communicate with one another comprising;

a first pipe with an inlet and an outlet, and a second pipe with an inlet and an outlet, and a carrier component, wherein the first pipe is attached, in an inlet section, to the carrier component;

wherein the first pipe is secured, in an outlet section to the carrier component with a sliding fit;

wherein the second pipe whose inlet is connected in a communicating fashion to the outlet of the first pipe is secured, in an inlet section, with a sliding fit, on the carrier component;

wherein the second pipe is secured, in an outlet section, to the carrier component;

wherein the longitudinal center axes of the two pipes run parallel to one another;

further comprising where at least one of the sliding fits has a wire mesh which is supported radially on the outside of the respective pipe and which is secured directly or indirectly to the carrier component; and the wire mesh is composed of a plurality of mesh pillows which are spaced apart from one another and arranged distributed in the circumferential direction about the respective pipe.

2. The pipe arrangement of claim 1, further comprising a bent connecting pipe which connects the outlet of the first pipe to the inlet of the second pipe.

3. The pipe arrangement of claim 1, further comprising a connecting chamber into which the outlet of the first pipe and the inlet of the second pipe lead in an open fashion.

4. The pipe arrangement of claim 1, further comprising a fastener attached to the carrier component in which the wire mesh is secured.

5. The exhaust gas treatment device of claim 1, where the first and second pipes are arranged relative to the carrier component such that flow of fluid from the inlet section of the first pipe to the outlet section of the first pipe occurs along the longitudinal center axis of the first pipe in a first direction and flow of fluid from the inlet section of the second pipe to the outlet section of the second pipe occurs along the longitudinal center axis of the second pipe in a second direction that is opposite the first direction.

6. An exhaust gas treatment device, for an exhaust system of an internal combustion engine, comprising:

a housing which has at least one inlet and at least one outlet;

a pipe arrangement which has at least two pipes which communicate with one another comprising;

a first pipe with an inlet and an outlet, and a second pipe with an inlet and an outlet, wherein the first pipe is attached, in an inlet section, to the housing; wherein the first pipe is secured, in an outlet section, to the housing with a sliding fit;

wherein the second pipe whose inlet is connected to the outlet of the first pipe is secured, in an inlet section, to the housing with a sliding fit;

wherein the second pipe is secured, in an outlet section, to the housing;

wherein the longitudinal center axes of the first pipe and of the second pipe run parallel to one another;

further comprising where at least one of the sliding fit arrangements has a wire mesh which is supported radially on the outside of the respective pipe and which is secured directly or indirectly to the housing; and the wire mesh is composed of a plurality of mesh cushions which are spaced apart from one another and are arranged distributed in the circumferential direction about the respective pipe.

7. The exhaust gas treatment device of claim 6, where the first pipe comprises at least one particle filter element.

8. The exhaust gas treatment device of claim 6, where the first pipe comprises at least one oxidation catalytic converter element.

9. The exhaust gas treatment device of claim 6, where the first pipe has a radially removable axial section.

10. The exhaust gas treatment device of claim 9, where the radially removable axial section comprises at least one particle filter element.

11. The exhaust gas treatment device of claim 6, further comprising a third pipe with an inlet and an outlet, whose inlet is connected in a communicating fashion to the outlet of the second pipe.

12. The exhaust gas treatment device of claim 11, further comprising a fourth pipe with an inlet and an outlet, whose inlet is connected in a communicating fashion to the outlet of the third pipe.

13. The exhaust gas treatment device of claim 12, where the fourth pipe leads to the outlet.

14. The exhaust gas treatment device of claim 11, where the third pipe comprises at least one SCR catalytic converter.

15. The exhaust gas treatment device of claim 6, further comprising a metering device for feeding in a fluid educt.

16. The exhaust gas treatment device of claim 15, where the second pipe serves as a mixing section for the exhaust gas and fed-in educt.

17. The exhaust gas treatment device of claim 15, where the metering device feeds the educt into the import section of the second pipe.

18. The exhaust gas treatment device of claim 6, further comprising a bent connecting pipe which connects the outlet of the first pipe to the inlet of the second pipe.

19. The exhaust gas treatment device of claim 6, further comprising a connecting chamber into which the outlet of the first pipe and the inlet of the second pipe lead in an open fashion.

20. The exhaust gas treatment device of claim 6, where the wire mesh is secured in a fastener which is attached to the housing.

21. The exhaust gas treatment device of claim 20, where the fastener is generally U-shaped defining an open annular groove which opens radially inward, the wire mesh inserted into the annular groove, the fastener providing axial support on an upstream side and a downstream side of the wire mesh.

22. The exhaust gas treatment device of claim 6, where the first and second pipes are arranged relative to the carrier component such that flow of fluid from the inlet section of the first pipe to the outlet section of the first pipe occurs along the longitudinal center axes of the first pipe in a first direction and flow of fluid from the inlet section of the second pipe to the outlet section of the second pipe occurs along the longitudinal center axis of the second pipe in a second direction that is opposite the first direction.

* * * * *